US007204211B2

(12) United States Patent
Kenchington et al.

(10) Patent No.: US 7,204,211 B2
(45) Date of Patent: Apr. 17, 2007

(54) ARRANGEMENT OF AN INTERNAL COMBUSTION ENGINE POPPET VALVE AND AN ACTUATOR THEREFOR

(75) Inventors: Steven Kenchington, Norfolk (GB); Simon Paul Kuderovitch, Norfolk (GB)

(73) Assignee: Lotus Cars Limited, Norfolk (GB)

( * ) Notice: Subject to any disclaimer, the term of this patent is extended or adjusted under 35 U.S.C. 154(b) by 0 days.

(21) Appl. No.: 10/530,121

(22) PCT Filed: Sep. 1, 2003

(86) PCT No.: PCT/GB03/03783

§ 371 (c)(1),
(2), (4) Date: Apr. 1, 2005

(87) PCT Pub. No.: WO2004/033861

PCT Pub. Date: Apr. 22, 2004

(65) Prior Publication Data

US 2006/0048730 A1 Mar. 9, 2006

(30) Foreign Application Priority Data

Oct. 10, 2002 (GB) ..... 0223628.9

(51) Int. Cl.
*F01L 9/02* (2006.01)

(52) U.S. Cl. ..... 123/90.12; 123/90.15; 251/12; 251/57; 251/62; 251/325

(58) Field of Classification Search ..... 123/90.12
See application file for complete search history.

(56) References Cited

FOREIGN PATENT DOCUMENTS

| | | | |
|---|---|---|---|
| GB | 2394000 A | * | 4/2004 |
| JP | 60-085209 A | | 5/1985 |
| JP | 2000-045732 A | | 2/2000 |
| JP | 2000-282823 A | | 10/2000 |

* cited by examiner

*Primary Examiner*—Thomas Denion
*Assistant Examiner*—Kyle M. Riddle
(74) *Attorney, Agent, or Firm*—Fulwider Patton LLP

(57) ABSTRACT

The present invention (with reference to FIG. 1) is an arrangement of an internal combustion engine poppet valve and a hydraulic actuator therefor comprising: an actuator housing (16); spring means (104,105) for biassing the poppet valve (101) into engagement with a valve seat therefor; a first piston (1) of a first cross-sectional area slidable in a first chamber formed in the actuator housing (16), the first piston (1) having a passage therethrough for the flow of hydraulic fluid; and a second piston (15) of a second cross-sectional area smaller than the first cross-sectional area slidable in a second chamber formed in the actuator housing (16), the second chamber opening on to the first chamber; wherein: the first chamber is connectable to a pressurised hydraulic fluid supply line and to a hydraulic fluid return line; and the second piston has an upper surface (110) engageable by a lower surface of the first piston; and the first piston is configured without a passage which is both aligned with the second piston and which has a portion of constant cross-sectional area greater than the said second cross-sectional area.

14 Claims, 1 Drawing Sheet

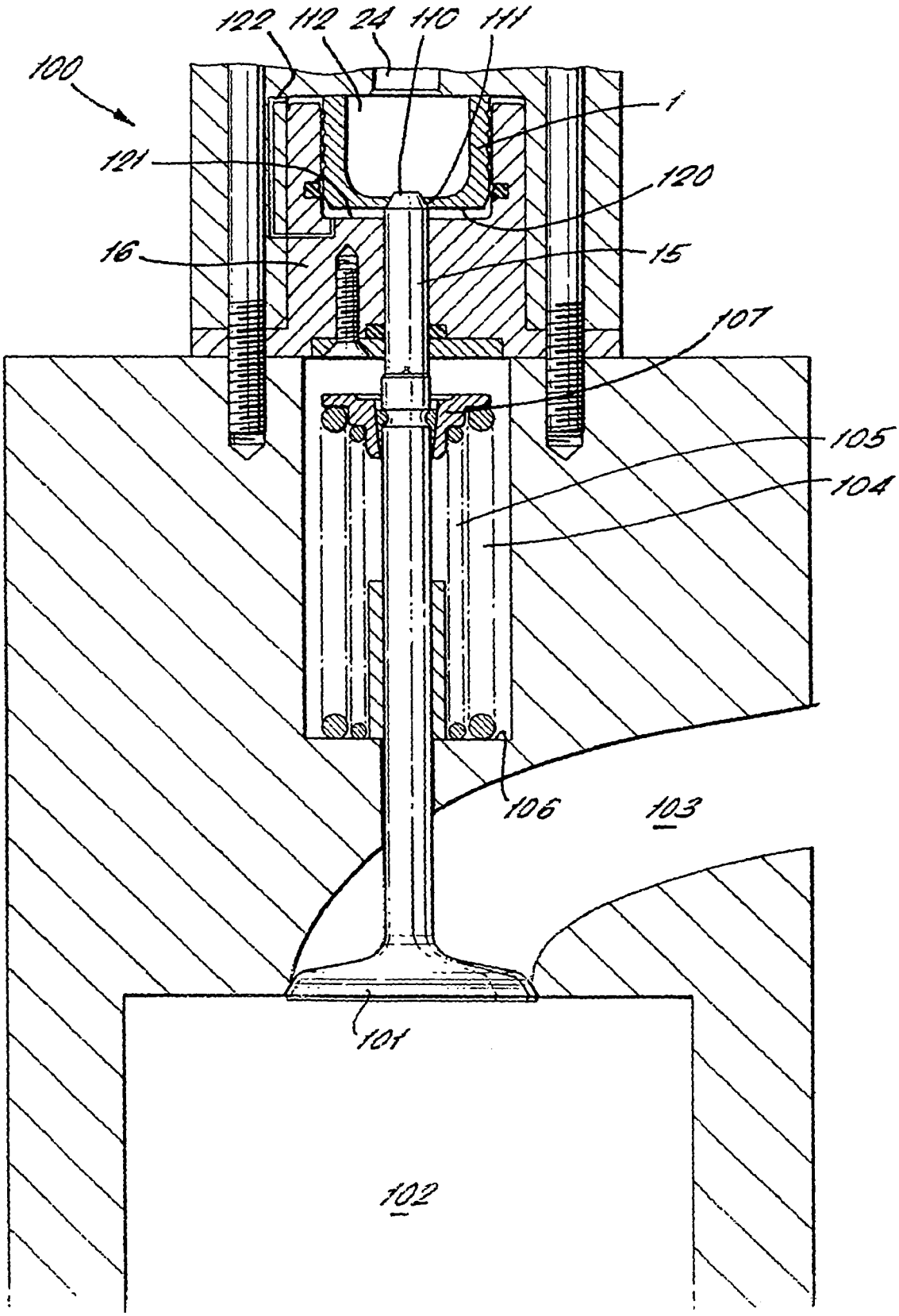
122
112
24
110
111
100
1
121
120
16
15
107
105
104
106
103
101
102

ARRANGEMENT OF AN INTERNAL COMBUSTION ENGINE POPPET VALVE AND AN ACTUATOR THEREFOR

RELATED APPLICATIONS

This application is a U.S. national phase of PCT/GB2003/003783, filed 01 Sep. 2003, which claims priority from Great Britain Application Serial No. 0223628.9, filed Oct. 10, 2002.

The present invention relates to an arrangement of an internal combustion engine poppet valve and an actuator therefor.

The majority of internal combustion engines have poppet valves as inlet and exhaust valves controlling flow of air into the combustion chambers of the combustion engines and flow of combusted gases to exhaust. Conventionally, the poppet valves have been operated by cams on rotating camshafts. More recently, poppet valves have been operated by hydraulic actuators. In large diesel engines residual pressure in the combustion chambers can be 70 bar when the exhaust valves are opened. This requires considerable force to be applied on the exhaust valves.

The present invention provides an arrangement of an internal combustion engine poppet valve and a hydraulic actuator therefor comprising:

an actuator housing;

spring means for biassing the poppet valve into engagement with a valve seat therefor;

a first piston of a first cross-sectional area slidable in a first chamber formed in the actuator housing, the first piston having a passage therethrough for the flow of hydraulic fluid; and a second piston of a second cross-sectional area smaller than the first cross-sectional area slidable in a second chamber formed in the actuator housing, the second chamber opening on to the first chamber; wherein:

the first chamber is connectable to a pressurized hydraulic fluid supply line and to a hydraulic fluid return line;

the second piston has an upper surface engageable by a lower surface of the first piston; and the first piston is configured without a passage which is both aligned with the second piston and which has a portion of constant cross-sectional area greater than the said second cross-sectional area; whereby:

in order to open the poppet valve: the first chamber is connected to the pressurized hydraulic fluid supply line and then supplied pressurized hydraulic fluid acts initially on the first piston to give rise to a first magnitude force which is initially relayed via the second piston to the engine valve to open the valve; initially the first piston, the second piston and the engine valve all move together under the action of the first magnitude force until the first piston reaches an end stop; and thereafter the supplied pressurized hydraulic fluid flows from the first chamber through the passage in the first piston to act on the second piston and to thereby give rise to a second smaller magnitude force under the action of which the second piston and the valve move together until the valve is fully open;

in order to close the previously opened poppet valve: the first chamber is connected to the hydraulic fluid return line and then the biassing force applied by the spring means to the valve forces the valve to move back towards its valve seat; initially the valve and the second piston move together with the second piston expelling fluid from the second chamber via the passage in the first piston to the hydraulic fluid return line until the second piston engages the first piston; and thereafter the first piston, the second piston and the valve all move together under the biassing force applied by the spring means with the first piston expelling hydraulic fluid from the first chamber to the hydraulic fluid return line until the poppet valve engages the valve seat therefor; and the movement of the second piston relative to the first piston is limited by abutment of the upper surface of the second piston with the lower surface of the first piston.

The actuator applies a large force on e.g. an exhaust valve for the first part of the engine valve motion, after which the pressure in the combustion chamber has decayed and the actuator need not apply such a large force. Thereafter, the amount of fluid required for each millimetre of valve motion is much reduced because the operative cross-sectional area of the actuator is much less than in the first part of the valve stroke.

The invention also has the advantage that the initial and final velocity of the engine valve is lower. The gradient of the lift profile at the opening and closing of the valve is hence lower. This has the benefit of reducing the noise, vibration and harshness due to the valve and improves engine valve overlap capability.

A preferred embodiment of internal combustion engine valve actuator will now be described with reference to the accompanying FIGURE which is a cross-sectional view of the actuator.

In the FIGURE there can be seen an actuator 100, which operates a poppet valve 101 which serves as an exhaust valve controlling flow of combusted gases from a cylinder 102 to an exhaust passage 103. The valve 101 is biassed by a pair of concentric valve springs 104,105 which act between a spring seat surface 106 and a collar 107 secured to the top of the poppet valve 101. The top of the poppet valve 101 is engaged by a small piston 15 slidable in a first bore in an inner actuator housing 16. The top of the small piston 15 is engageable by a large piston 1 slidable in a second bore in the inner actuator housing 16 aligned with the first bore. The actuator 100 has an outer actuator housing 13 which surrounds the inner actuator housing 16.

Extending through the outer actuator housing 13 is a passage 24 for flow of hydraulic fluid. A valve (not shown) will be used to control flow of hydraulic fluid through the passage 24 to and from the actuator 100.

As shown in the FIGURE the valve 101 is biassed into its valve seat by the springs 104, 105. A frusto-conical top portion 110 of the piston 15 is engaged in a socket of matching shape and configuration in the lower surface of the piston 1. A fluid passage 111 opens onto the socket to allow fluid flow across the piston 1. As shown in the FIGURE, the valve springs 104, 105 have biassed piston 15 into engagement with the piston 1 and biassed both pistons 1, 15 into their uppermost positions. The passage 111 does not have a portion of cross-sectional area greater than the cross-sectional area of the small piston 15 and is designed to permit fluid flow through the piston 1 and not to permit movement of the small piston 15 within the piston 1.

If the poppet valve 101 is an exhaust valve in a large capacity diesel engine then the pressure in the cylinder 102 can be as high as 70 bar when the actuator 100 first opens the valve 101. In order to apply a force on the valve 101 sufficient to open the valve the piston 1 is provided in the actuator. When pressurized fluid is introduced into the chamber 112 defined between the piston 1 and the outer actuator housing 13 then the fluid acts to slide the piston 1 downwardly in the inner housing 16. The force applied to the valve 101 is the product of pressure of the pressurized fluid and the area of the piston 1.

The piston 1 is slid down in the bore in the inner housing 16 until it abuts the end of the bore in the inner housing 16 in which it slides. Thereafter, the pressurized fluid acts to move the piston 15 relative to the first piston 1, the piston 15 sliding in the inner housing 16, with hydraulic fluid flowing through the aperture 111 in piston 1. Therefore the first part of the opening motion of the valve 101 is occasioned by motion of the pistons 1 and 15 together and thereafter the opening motion of the valve 101 is occasioned by the motion of the smaller piston 15 only.

The force applied by the piston 15 on the valve 101 is the product of the pressure of the fluid and the cross-sectional area of the piston 15. Since the cross-sectional area of piston 15 is much less than the cross-sectional area of piston 1 the force applied by the piston 15 on valve 101 is much less than the force applied by piston 1. On the other hand, when the valve 101 is moved under control of piston 1 then the amount of fluid needed for each millimetre of motion is the product of the distance travelled and the cross-sectional area of piston 1, whereas when the valve 101 moves under the control of piston 15 the volume of fluid for each millimetre of motion is the product of the distance travelled and the much smaller cross-section of the piston 15. The power required of a hydraulic pump pressuring the fluid supplied to the actuator is proportional to the rate of flow of fluid and thus reducing the amount of fluid needed for each millimetre of valve motion is an energy saving measure.

The pressure in the cylinder 102 quickly decays to atmosphere once the valve 101 is opened. Thus the actuator can easily move the valve 101 with the lower force applied by piston 15.

To prevent a build up of fluid between the lower face 120 of the piston 1 and the opposing face 121 of the chamber in which the piston 1 moves, leakage of fluid past the cylindrical outer surface of the piston 1 is permitted. Also a small passage 122 allows fluid to flow from between the faces 120, 121 to the upper side of the piston 1 as the piston 1 moves downwardly.

The fluid trapped between the faces 120, 121 will have the beneficial effect of acting as a cushion for the piston 1 to prevent the piston 1 impacting the face 121 with the consequent problems of noise and wear.

When the valve 101 is to be returned to its valve seat the chamber 112 is connected via passage 24 to a fluid return and then the valve springs 104, 105 force the valve 101 and the piston 15 upwardly with fluid expelled from between the pistons 1 and 15 through the orifice 111 in the piston 1 to the passage 24. As the piston 15 moves upwardly the frusto-conical top of the piston 15 engages with and locates in the conical recess in the lower surface of piston 1, with the co-operating conical surfaces acting to centre the piston relative to the piston 1. Also as the facing surfaces of the frusto-conical top 110 of the piston 15 and the aperture 111 draw close to one another then the aperture defined therebetween narrows and thus the flow of fluid therethrough is restricted. This has a beneficial damping effect on the motion of the piston 15 which serves to soften the impact as the piston 15 comes into abutment with the piston 1. Once the piston 1 fully engages piston 15 then the two pistons 1 and 15 move together under the action of the springs 104 and 105 until the valve 101 is returned to its valve seat.

Ideally, the transverse cross-section diameter of the piston 15 is chosen to be approximately the same as the transverse cross-section of the stem of valve 101 and the transverse cross-section diameter of the piston 1 is chosen to be approximately the same as the maximum diameter of the valve head of the valve 101.

The diameter of the piston 1 will be chosen to be as small as possible given that for a set pressure of supplied hydraulic fluid a certain force must be achievable to overcome residual pressure in the chamber 102. Also the diameter of the piston 15 is chosen to be as small as possible given that the piston, with a set pressure supplied by hydraulic fluid, must be able to apply a force sufficient to overcome the biassing forces of the springs 104, 105 throughout the travel of valve 101.

The engine valve 101 will typically have a total stroke of 15 mm of which only the initial 1 to 1.5 mm will be occasioned by motion of the large piston 1 and the reminder of which will be occasioned by the smaller piston 15.

The invention claimed is:

1. An arrangement of an internal combustion engine poppet valve and a hydraulic actuator therefor comprising:

an actuator housing;

spring means for biasing the poppet valve into engagement with a valve seat therefor;

a first piston of a first cross-sectional area slidable in a first chamber formed in the actuator housing, the first piston having a passage therethrough for the flow of hydraulic fluid, a proximal end nearest the poppet valve, a distal end furthest from the poppet valve, and a lower surface located at the proximal end of the first piston; and a second piston of a second cross-sectional area smaller than the first cross-sectional area slidable in a second chamber formed in the actuator housing, the second chamber opening on to the first chamber; wherein:

the first chamber is connectable to a pressurized hydraulic fluid supply line and to a hydraulic fluid return line; and the second piston has an upper surface engageable with the lower surface of the first piston located at the proximal end of the first piston; and the first piston has a socket in the lower surface thereof of a shape and configuration which matches the upper surface of the second piston and the passage through the first piston opens into the socket;

wherein in order to open the poppet valve: the first chamber is connected to the pressurized hydraulic fluid supply line and then supplied pressurized hydraulic fluid acts initially on the first piston to give rise to a first magnitude force which is initially relayed via the second piston to the engine valve to open the valve;

initially the first piston, the second piston and the engine valve all move together under the action of the first magnitude force until the first piston reaches an end stop; and thereafter the supplied pressurized hydraulic fluid flows from the first chamber through the passage in the first piston to act on the second piston and to thereby give rise to a second smaller magnitude force under the action of which the second piston and the valve move together until the valve is fully open; and in order to close the previously opened poppet valve: the first chamber is connected to the hydraulic fluid return line and then the biasing force applied by the spring means to the valve forces the valve to move back towards its valve seat; initially the valve and the second piston move together with the second piston expelling fluid from the second chamber via the passage in the first piston to the hydraulic fluid return line until the second piston engages the first piston with the upper surface of the second piston engaging the socket in the lower surface of the first piston to seal the passage through the first piston and with such engagement limiting the movement of the second piston relative to the first piston and preventing the second piston from sliding within the first piston along the passage in the first piston; and thereafter the first piston, the second piston and the valve all move together under the biasing force applied by the spring means with the first piston expelling hydraulic fluid from the first chamber to the hydraulic fluid return line until the poppet valve engages the valve seat therefor.

2. An arrangement of an internal combustion engine poppet valve and a hydraulic actuator therefor as claimed in claim 1 wherein the second piston directly abuts the top of a valve stem of the poppet valve.

3. An arrangement of an internal combustion engine poppet valve and a hydraulic actuator therefor as claimed in claim 1 wherein the first and second pistons directly abut each other when moving together.

4. An arrangement of an internal combustion engine poppet valve and a hydraulic actuator as claimed in claim 1 wherein the first chamber is formed in the actuator housing by a first diameter drilling and the second chamber is formed in the actuator housing by a second diameter drilling which is aligned with the first diameter drilling.

5. An arrangement of an internal combustion engine poppet valve and an actuator therefor as claimed in claim 1 wherein both of the abutment surfaces are conical.

6. An arrangement of an internal combustion engine poppet valve and an actuator therefor as claimed in claim 5 wherein the matched conical surfaces together act to restrict flow of fluid through the passage in the first piston as the second piston comes into abutment with the first piston and thereby soften impact of the first piston with the second piston.

7. An arrangement of an internal combustion engine poppet valve and an actuator therefor as claimed in claim 1 comprising a passage through the actuator through which hydraulic fluid trapped between one side of first piston and a facing surface of the first chamber as the first piston approaches the end stop therefor can be relayed to the first chamber on the other side of the first piston.

8. An arrangement of an internal combustion engine poppet valve and an actuator therefor as claimed in claim 1 wherein the spring means comprises one or more valve springs acting between a collar attached to the poppet valve and a surface provided on the engine cylinder head.

9. An arrangement of an internal combustion engine poppet valve and a hydraulic actuator therefor as claimed in claim 2 wherein the first and second pistons directly abut each other when moving together.

10. An arrangement of an internal combustion engine poppet valve and a hydraulic actuator as claimed in claim 2 wherein the first chamber is formed in the actuator housing by a first diameter drilling and the second chamber is formed in the actuator housing by a second diameter drilling which is aligned with the first diameter drilling.

11. An arrangement of an internal combustion engine poppet valve and an actuator therefor as claimed in claim 2 wherein both of the abutment surfaces are conical.

12. An arrangement of an internal combustion engine poppet valve and an actuator therefor as claimed in claim 11 wherein the matched conical surfaces together act to restrict flow of fluid through the passage in the first piston as the second piston comes into abutment with the first piston and thereby soften impact of the first piston with the second piston.

13. An arrangement of an internal combustion engine poppet valve and an actuator therefor as claimed in claim 12 comprising a passage through the actuator through which hydraulic fluid trapped between one side of first piston and a facing surface of the first chamber as the first piston approaches the end ;stop therefor can be relayed to the first chamber on the other side of the first piston.

14. An arrangement of an internal combustion engine poppet valve and an actuator therefor as claimed in claim 13 wherein the spring means comprises one or more valve springs acting between a collar attached to the poppet valve and a surface provided on the engine cylinder head.

* * * * *